US008146193B1

(12) United States Patent
Franzino et al.

(10) Patent No.: US 8,146,193 B1
(45) Date of Patent: Apr. 3, 2012

(54) LAUNCHER FOR TUBE CLEANING PROJECTILES

(75) Inventors: Joseph J Franzino, Redding, CT (US); George M Cruz, Norwalk, CT (US)

(73) Assignee: Goodway Technologies Corporation, Stamford, CT (US)

( * ) Notice: Subject to any disclaimer, the term of this patent is extended or adjusted under 35 U.S.C. 154(b) by 0 days.

(21) Appl. No.: 12/806,430

(22) Filed: Nov. 29, 2010

(51) Int. Cl.
*B08B 9/053* (2006.01)
*F41B 11/00* (2006.01)

(52) U.S. Cl. ..... 15/3.5; 124/75

(58) Field of Classification Search ..... 124/65, 124/71, 73, 75; 15/3.5
See application file for complete search history.

(56) References Cited

U.S. PATENT DOCUMENTS

| | | | | | |
|---|---|---|---|---|---|
| 1,806,270 | A | * | 5/1931 | Thompson | 15/3.5 |
| 1,808,870 | A | * | 6/1931 | Strasburg | 15/3.5 |
| 3,631,555 | A | * | 1/1972 | Hurst et al. | 15/3.5 |
| 3,823,847 | A | * | 7/1974 | Ware | 222/79 |
| 4,049,367 | A | * | 9/1977 | Tominaga et al. | 425/77 |
| 4,185,714 | A | * | 1/1980 | Pascouet et al. | 181/120 |
| 4,303,141 | A | * | 12/1981 | Pascouet | 181/120 |
| 4,503,929 | A | * | 3/1985 | Farris et al. | 181/118 |
| 4,594,697 | A | * | 6/1986 | Pascouet | 367/146 |
| 6,119,955 | A | * | 9/2000 | Starr | 239/11 |

* cited by examiner

*Primary Examiner* — Troy Chambers
(74) *Attorney, Agent, or Firm* — Patrick J Walsh

(57) ABSTRACT

A launcher for heat exchanger tube cleaning projectiles using operator selected compressed air application for manipulating launcher operating components including hydraulic bolt, projectile plunger, and water valve to fire projectile with pressurized water, and to reset operating components for subsequent projectile firings. Launcher has means for venting heat exchanger tube over- or under-pressure occurring in practice, and further has visual indicator of force applied in firing projectiles, and of tube being clear after exiting of projectile from the tube.

11 Claims, 8 Drawing Sheets

LAUNCHER FOR TUBE CLEANING PROJECTILES

BACKGROUND OF THE INVENTION

The present invention relates to tube cleaning and particularly to launching tube cleaning projectiles by pressurized water through heat exchanger tubes for cleaning tube interior surfaces so as to maintain thermodynamic efficiency, to extend tube life, and to clear away deposits that constrict fluid flow through the tubes.

Shell and tube heat exchangers comprise a bundle of tubes with ends mounted to tube sheets that close each end of the shell. In normal operation, hard deposits such as rust and scale containing calcium, and soft deposits including slime and loose dirt build up on the interior surface of the tubes so as to diminish thermal efficiency and restrict fluid flow through the tubes. To maintain thermal efficiency and design flow in operation of the heat exchanger, it is necessary to remove such deposits on a regular maintenance schedule.

These deposits are removed mechanically by means of a tube cleaning projectile or plug driven through the tube by pressurized media including air, water, steam, or other gas. The projectile outer diameter is greater than tube bore diameter and the projectile surface is fitted with cleaning elements including brush and scraper components configured for effective cleaning of the interior wall. The projectile forms a seal against the interior wall such that the full force of the fluid pressure acts to move the projectile through the tube. Preferably, the projectile pushes removed deposits ahead through the tube so both projectile and deposits are ejected from the far end of the tube in an exhaust stream of propelling media.

Hand held devices of the type described in Thompson U.S. Pat. No. 1,806,270 are used to position a plug for entry into a heat exchanger tube, and to propel the plug through the conduit with fluid pressure, typically, compressed air. The plugs preferred by Thompson are of a resilient nature and are preferably made of rubber. Strasburg U.S. Pat. No. 1,808,870 uses compressed air to clean condenser tubes by propelling rubber balls through the tubes. Oberhuber U.S. Pat. No. 1,867,751 discloses a gun with trigger operated valve for driving condenser cleaning slugs through tubes utilizing steam, water, or high pressure air. Wallace U.S. Pat. No. 3,451,091 discloses a device for cleaning tubes of boilers, condensers and heat exchangers utilizing a plug formed from conventional rope fed from a coil with its free end wrapped, inserted into a tube end, severed from the body of the rope, and forced through the tube by air or steam supplied through a handle.

The present invention is directed to improvements in launchers and devices for tube cleaning by propelling projectiles, plugs and the like to brush or scrape deposits from the interior surface of the substantial number of tubes comprising a heat exchanger, and doing so in an economic plant maintenance program.

SUMMARY OF THE INVENTION

The present invention provides a new and improved launcher for cleaning the interior wall of heat exchanger tubes using projectiles driven through the tubes with pressurized water.

In a preferred embodiment, a hand held tube cleaning launcher positions and fires cleaning projectiles through heat exchanger tubes in quick succession for executing an efficient maintenance schedule. The launcher comprises an outer casing or housing defining an interior axial chamber for receiving reciprocating operating components including hydraulic bolt and a projectile plunger. The outer casing also incorporates a projectile feed magazine for receiving and positioning projectiles in preparation for launch through tubes.

The outer casing chamber receives a sliding hydraulic bolt aligned on the outer casing X-X' axis for the purpose of delivering an hydraulic charge to fire each projectile launched by the launcher. The hydraulic bolt is supported on X-X' axis for reciprocating movement, first, by means of a cylindrical spool valve itself stationary within the outer casing, and secondly, by the sliding projectile plunger mounted between outer casing and in telescoping relation to the hydraulic bolt. Thus the hydraulic bolt is centered on the X-X' axis and supported there by spool valve and sliding projectile plunger. The sliding plunger has a projectile ram at its head end for pushing each projectile into place for launch down a tube.

The hydraulic bolt and the projectile plunger each incorporate double acting air pistons for operating both bolt and plunger.

The tube cleaning launcher is provided with compressed air control for coordinating movement of launcher mechanisms in order to ram a projectile from feed position to firing position within a tube end, and to move the hydraulic bolt into registry with spool valve apertures for passing pressurized water through the hydraulic bolt to fire each projectile. After launch, control compressed air returns projectile ram to start position and retracts hydraulic bolt to start position.

Preferably the compressed air control system includes an actuating trigger and air lines for directing control air accordingly. The actuating trigger moves air control valves to admit compressed air, first, to an air piston for the projectile ram, and second, to an air piston for the hydraulic bolt.

Thus a projectile is rammed into firing position, and the hydraulic bolt is advanced for registry of its water ports with corresponding water ports of the spool valve so as to pass pressurized water to fire the waiting projectile. The operator can hold this firing position to ensure the projectile has passed through and out of the tube. When the operator releases the actuating trigger from the firing position, another air control valve admits compressed air to the return faces of the hydraulic bolt air piston and the projectile plunger air piston. In this way the hydraulic bolt and projectile plunger are returned to initial or normal operating positions.

Compressed air operation of launcher control components and pressurized water for launching projectiles substantially reduces time needed for cleaning each tube such that down time is reduced for executing a plant maintenance schedule.

In an aspect of the invention, projectiles can be fed manually or by magazine into the launcher.

In another preferred embodiment of the invention, a tube cleaning launcher comprises a housing shell encasing operating components for driving cleaning projectiles through heat exchanger tubes. The housing shell forms left and right hand grips and positions an inner mechanism for ready alignment with heat exchange tubes. The inner mechanism comprises an outer axial casing affixed by its exterior to the shell and having an internal bolt incorporating operating components. The outer casing defines an interior axial chamber defining an air cylinder for the sliding bolt, a support surface for the sliding bolt, and a spool valve. The sliding bolt incorporates an hydraulic chamber, a double acting operating piston at near end, and valve sleeve at far end. The hydraulic bolt is reciprocated by double acting air piston in a launch direction simultaneously to align hydraulic bolt ports with a pressurized water source through the spool valve, and by means of the valve sleeve to provide a flow path for launch. The hydraulic bolt is then returned by the air piston to normal position. A compressed air circuit operated by a trigger enables an operator in rapid fire sequence to load and fire projectiles in an efficient maintenance program.

In another aspect of the invention, when the launcher operating trigger is released, a vacuum break and pressure relief valve automatically vents any back pressure occurring in a heat exchanger tube. Such excessive backpressure may occur in the course of water pressurization behind projectile being driven through a tube that is or becomes blocked to passage of the projectile. The main purpose of pressure relief is to mitigate reaction shock to the operator arising from sudden buildup of excessive pressure within a tube. In accordance with the invention, a tube is completely depressurized before the launcher nozzle is disengaged from each tube.

In another aspect of the invention, a visual indicator provides a reading of the effectiveness of each shot in terms of whether each projectile received the full available driving force of pressurized water, and a reading indicating that each projectile has exited the far end of each tube.

The present invention, then, provides a tube cleaning launcher capable of driving a variety of tube cleaning plugs each suited to removal of a particular type deposit whether hard or soft through a bundle of heat exchanger tubes for effective tube cleaning and for executing a time-efficient maintenance program.

Specific examples are included in the following description for purposes of clarity, but various details can be changed within the scope of the present invention.

OBJECTS OF THE INVENTION

An object of the invention is to provide a tube cleaning launcher for quickly loading and firing tube cleaning projectiles.

Another object of the invention is to provide a tube cleaning launcher for loading and firing tube cleaning projectiles in which one of several different types of projectiles are loaded into the launcher chamber, rammed into tube entry position, and fired down the tube by a charge of pressurized water.

Another object of the invention is to provide a launcher for tube cleaning projectiles in which operating components are actuated by compressed air, and projectiles are driven by pressurized water through heat exchanger tubes.

Another object of the invention is to provide a tube cleaning launcher for loading and firing tube cleaning projectiles by means of pressurized water with relief means for dissipating pressurized shock in the event of failure of a projectile to pass through a tube, or in the event a tube is blocked.

Another object of the invention is to provide a sight gauge for indicating pressure level of each water charge released by the launcher for driving a projectile through a tube, and for indicating when a projectile has passed through a tube.

Other and further objects of the invention will become apparent with an understanding of the following detailed description of the invention or upon employment of the invention in practice.

BRIEF DESCRIPTION OF THE DRAWING

Preferred embodiments of the invention have been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENTS

Figure 1:
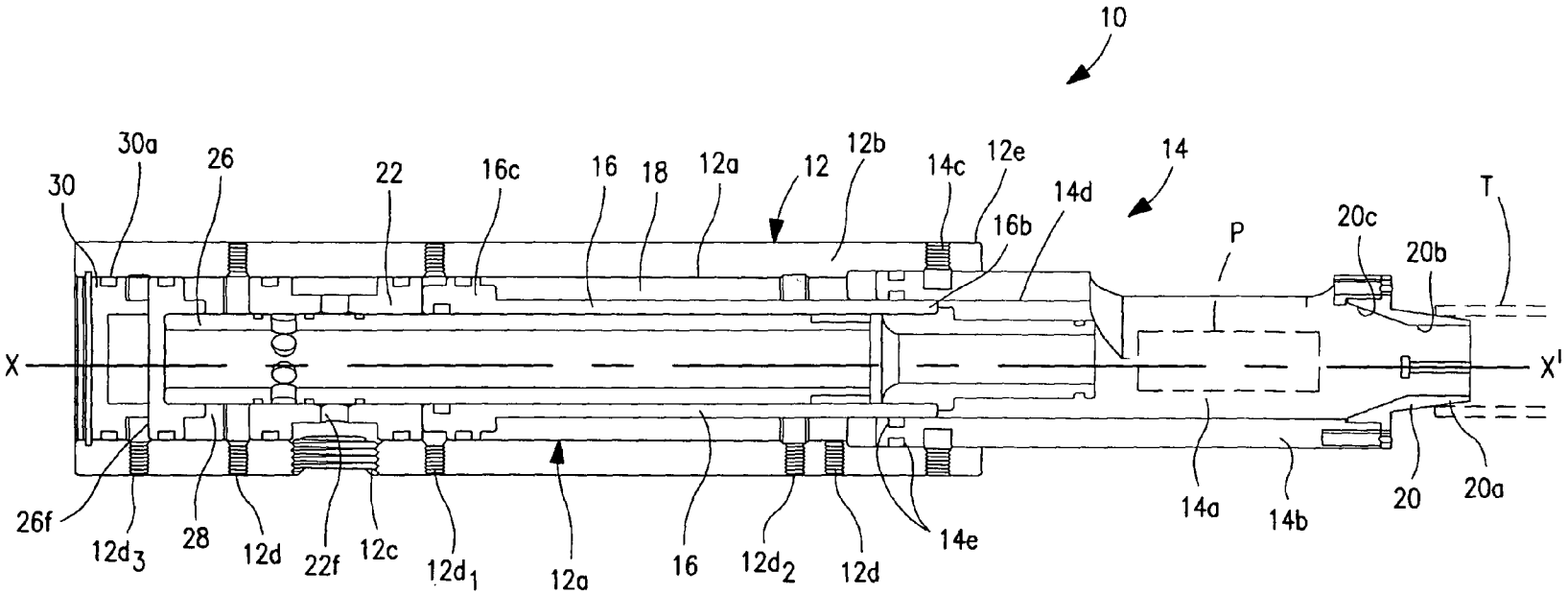
FIG. 1 is a side elevation section view of a preferred embodiment of tube cleaning launcher according to the invention showing launcher operating components in initial position for firing a projectile.
Figure 2:
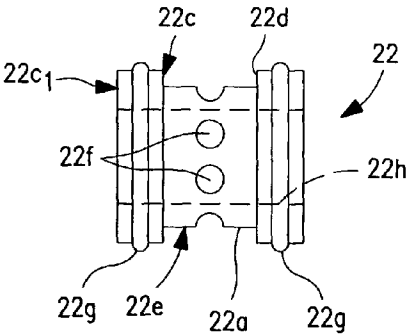
FIG. 2 is a side elevation view of a spool valve, an operating component of the launcher of FIG. 1.
Figure 3:
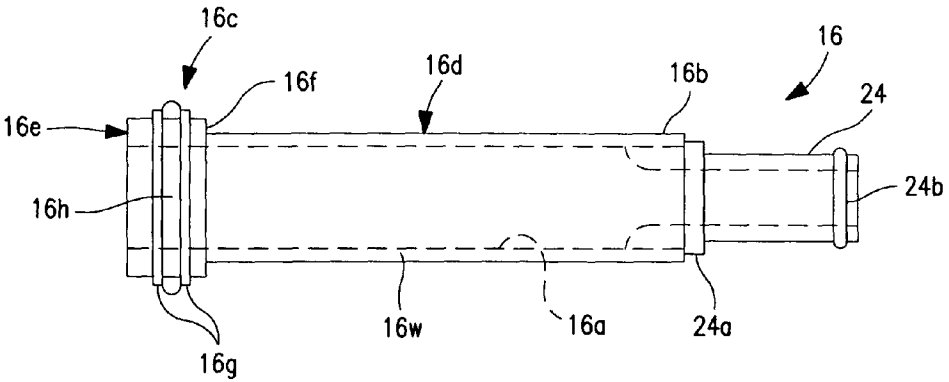
FIG. 3 is a side elevation view of a projectile plunger, an operating component of the launcher of FIG. 1.
Figure 4:
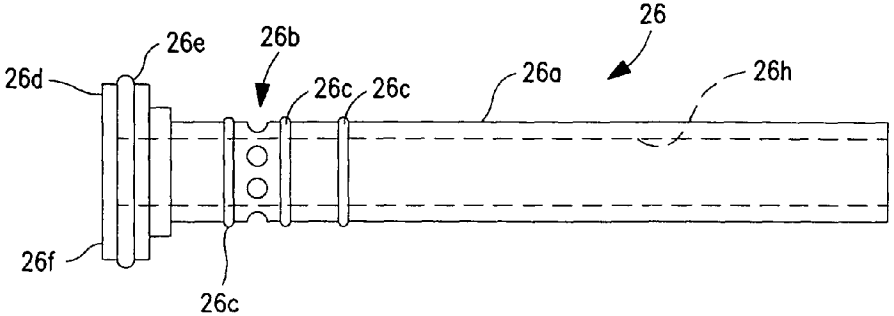
FIG. 4 is a side elevation view of a hydraulic bolt, one of the operating components of the launcher of FIG. 1.

Referring to FIGS. 1 through 5 of the drawing, a tube cleaning launcher 10 according to the invention comprises an tubular outer casing 12 with longitudinal axis X-X' defining an interior cylindrical bore or chamber 12*a* for receiving launcher operating components. Operating components load and fire a cleaning projectile P through a heat exchanger tube T, and after firing are reset for another operating cycle.

The outer casing or housing 12 comprises an elongate cylinder having wall 12*b* with openings including water inlet 12*c* for pressurized water utilized by the launcher for firing a projectile, and air inlets 12*d* for compressed air that moves operating components in loading, firing and resetting during launcher operating cycle.

The front end 12*e* of outer casing carries a nested launcher muzzle 14 with magazine 14*a* into which tube cleaning projectiles are loaded and fired. Launcher muzzle comprises an elongate cylinder 14*b* received in the front end of outer casing and held there by suitable fasteners such as set screws 14*c*. Inner cylindrical surface 14*d* of the muzzle defines a support surface for the front end of a projectile plunger 16 as it slides through its operating cycle. O-rings occupy inner and outer recesses 14*e* for sealing the launcher muzzle with respect to annular air cylinder 18 defined by inner surface of outer casing and outer surface of projectile plunger 16. The launcher muzzle further includes a conical nozzle 20 for guiding projectiles into firing position at entrance of each heat exchanger tube. The nozzle has conical outer surface 20*a* for insertion of the nozzle tip into a tube end. The nozzle has a forward inner surface 20*b* of cylindrical contour for preliminary alignment of projectile on tube axis as it enters a tube. Such alignment ensures that initial and subsequent orientation and movement of the projectile under a charge of pressurized water coincides with tube axis. The nozzle further includes inner conical entry surface 20*c* for guiding projectiles into the nozzle at the end portion their travel when being rammed by projectile plunger.

Figure 5:
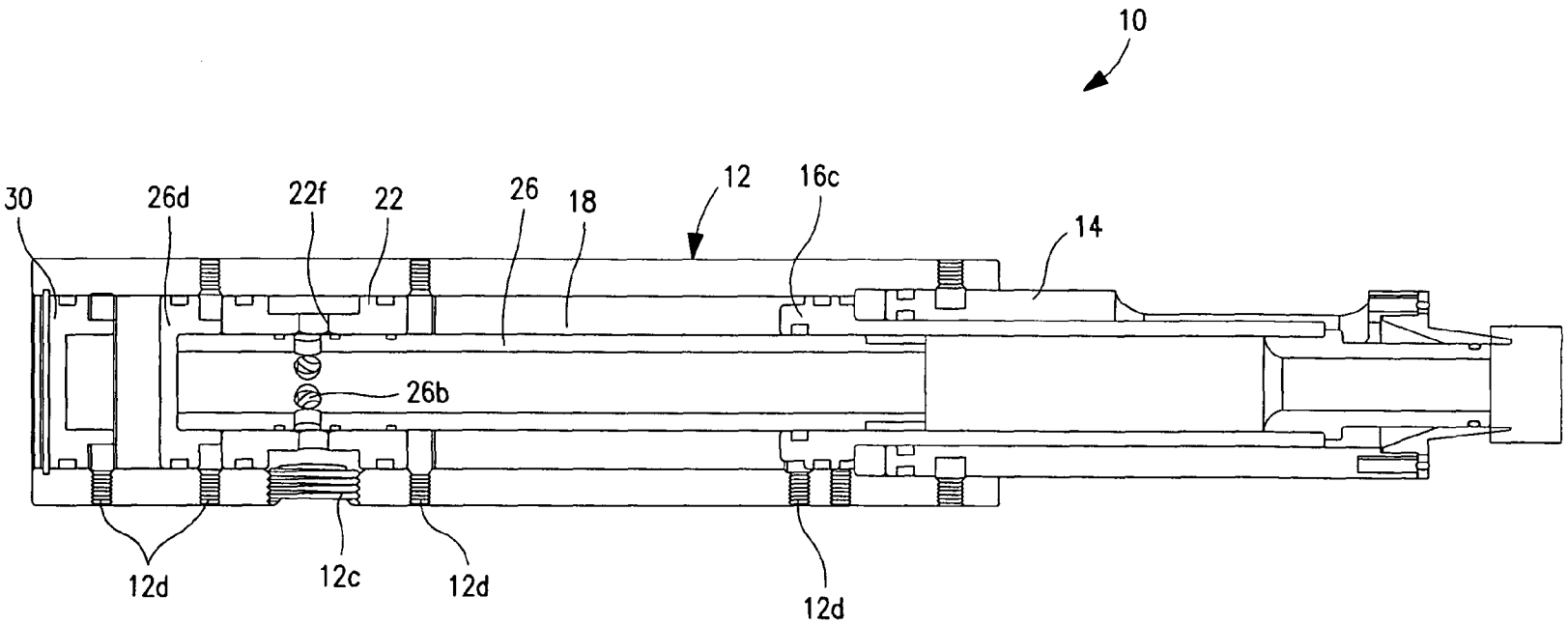
FIG. 5 is a side elevation section view of the tube cleaning launcher of FIG. 1 showing projectile launcher operating components in final position after firing a projectile.

Launcher operating components include a water side spool valve 22 (FIG. 2) in fixed position within chamber 12*a* and communicating with water inlet opening 12*c*. The spool valve is defined by cylindrical body wall 22*a* with circumferential shoulders 22*c-d* at each end defining annular water plenum 22*e*. A set of water ports 22*f* spaced around and through the body wall communicate with a pressurized water source via water inlet 12*c* for passing water through the spool valve. The spool valve further includes an axial bore 22*h* for slidably receiving the hydraulic bolt as shown in FIGS. 1 and 5. O-rings 22*g* set in recesses in end shoulders seal the water plenum with respect to interior chamber surface 12*a*.

Sliding projectile plunger 16 (FIG. 3) comprises an elongate cylinder with interior bore 16*a* defined by plunger wall 16*w*. At its front end 16*b*, the plunger wall is slidably supported at inner surface 14*d* of launcher muzzle described above. The projectile plunger is positioned within interior chamber 12*a* ahead of the spool valve 22 for the purpose of loading a tube cleaning projectile P into firing position at the entrance of a tube to be cleaned. At its rear end, the projectile plunger is fitted with a double acting piston 16*c* operating within annular cylinder 18 defined by space between outer casing chamber surface 12*a*, and plunger outer surface 16*d*. The piston is actuated in each direction by compressed air that moves the plunger through its operating cycle of ramming a projectile into firing position, and of being reset. Compressed air acts on piston end faces 16*e*, 16*f* when entering through air inlets $\mathbf{12}d_1$ and $\mathbf{12}d_2$ in a manner described in detail below. A pair of spaced circumferential ribs 16*g* encircle air piston and define ancillary surface area for the piston, and further define a recess for an O-ring 16*h* for sealing the air piston at interior chamber surface 12*a*.

A projectile ram 24 comprising a hollow tube is nested by press fit into the open front end 16*b* of the projectile plunger 16. An integral circumferential shoulder 24*a* defines a thrust surface between plunger and ram. A recess 24*b* at the front outer surface of the ram receives an O-ring for sealing engagement with projectile nozzle surface 20*b* described below.

A hydraulic bolt 26 (FIG. 4) occupies the inner axial space of inner chamber and is defined by sliding hydraulic cylinder 26*a* having a series of water ports 26*b* through its wall for registry with spool valve ports 22*f*, and surface recesses 26*c* for receiving O-rings for sealing cylinder outer surface with respect to both cylinder water ports and spool valve water ports. The back end of the hydraulic cylinder has a double acting air piston 26*d* cooperating with air cylinder 28 defined by that portion of outer casing chamber 28 between spool valve shoulder $\mathbf{22}c_1$ and outer casing end cap 30. The piston is actuated through its operating cycle by compressed air for the purpose of admitting and shutting off flow of pressurized water into the hydraulic bolt. Surface recess 26*e* in air piston receives an O-ring for seal against inner chamber wall. The hydraulic bolt has an operating cycle in which compressed air at air piston surface 26*f* through air inlet $\mathbf{12}d_3$ moves cylinder from position of FIG. 1 to that of FIG. 5 such that pressurized water enters the hydraulic chamber 26*h* and drives a projectile through a heat exchanger tube.

The rear end of the inner chamber has closure or end cap 30 (FIG. 1) with surface O-ring 30*a* for closing and sealing that end of the chamber and as noted above, defining the cylinder 28 in which air piston acts.

For operation of the launcher of FIGS. 1 and 5, a tube cleaning projectile or plug is placed manually or by cartridge into the magazine. Compressed air flows behind plunger air piston 16*c* via air inlet $\mathbf{12}d_1$ driving the plunger to the position of FIG. 5 thereby ramming the projectile into firing position. Air pressure is maintained behind the piston for holding the plunger fast against a projectile. Next compressed air flows via inlet $\mathbf{12}d_3$ behind the hydraulic bolt air piston 26*d* advancing the hydraulic bolt to the position of FIG. 5 where bolt and spool valve water ports 26*b* and 22*f* are aligned. Pressurized water then flows from entry port through hydraulic bolt, central bore of projectile ram to drive projectile down the length of a tube for cleaning its interior surface of hard or soft deposits according to cleaning requirements and projectile selected for the task.

Figure 6:
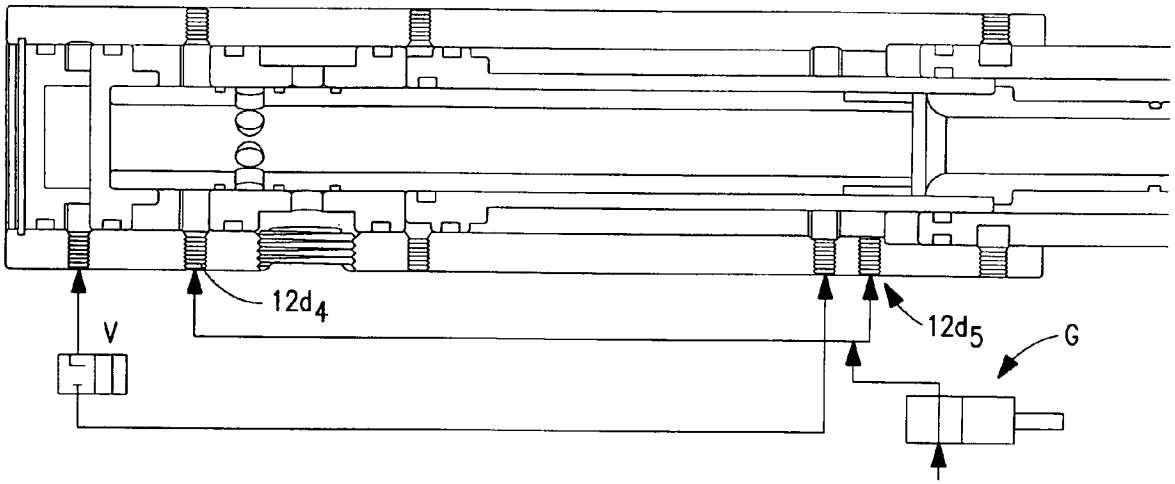
FIG. 6 is a side elevation section view of the tube cleaning launcher of FIG. 1 showing air control lines for reset of operating components in preparation for projectile launch.

FIG. 6 illustrates operating trigger G at "out" position for compressed air flow to air inlets $\mathbf{12}d_4$ and $\mathbf{12}d_5$ for reset respectively of hydraulic bolt 26 and projectile plunger 16 to initial position.

Figure 7:
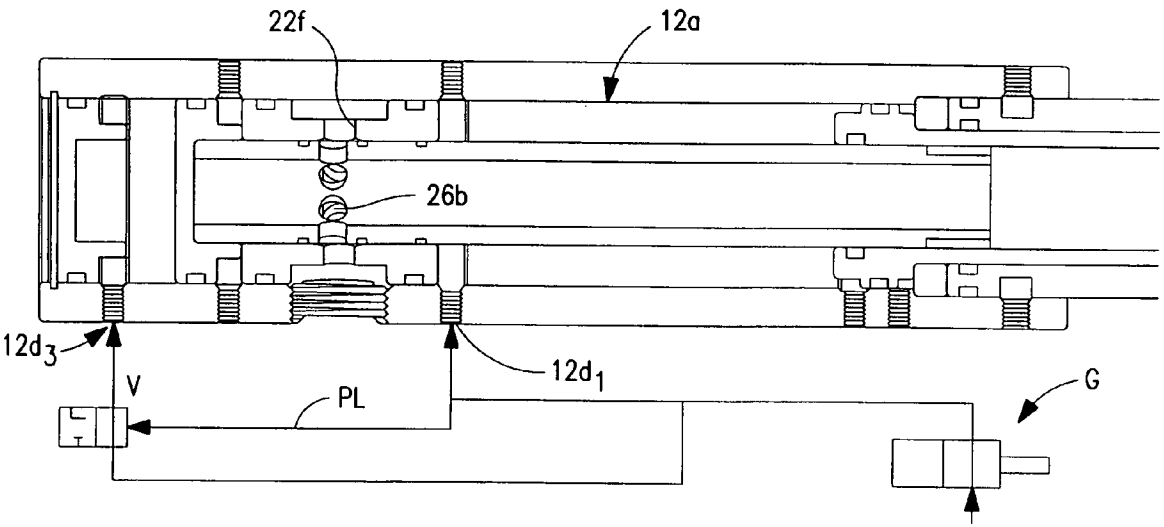
FIG. 7 is a side elevation section view of the tube cleaning launcher of FIG. 1 showing air control lines for operating components in projectile loading and launch.
Figure 8:
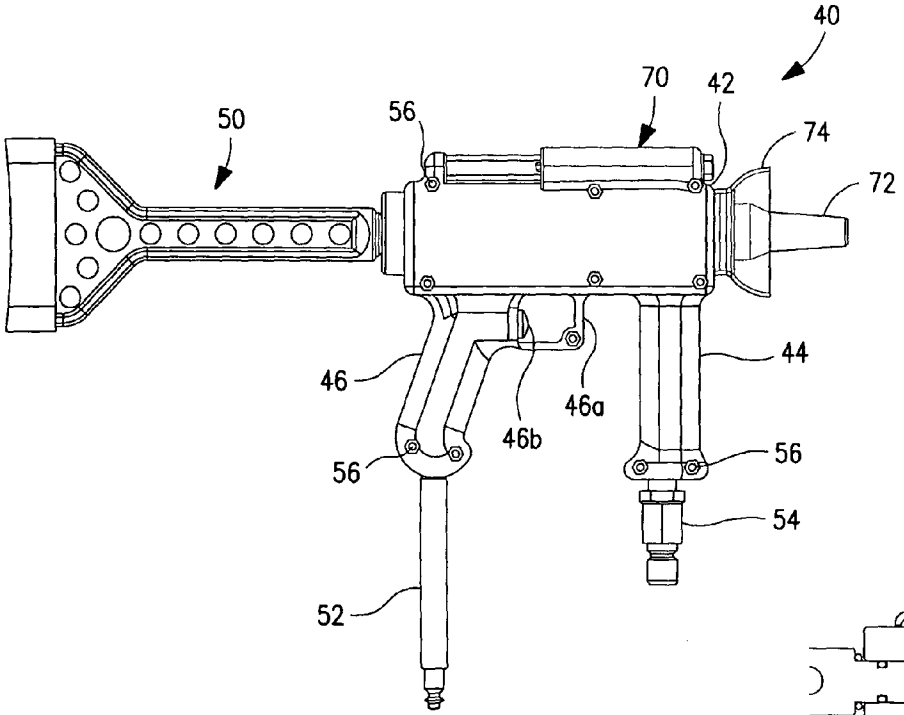
FIG. 8 is a side elevation view of another preferred embodiment of tube cleaning launcher according to the invention.

FIG. 7 illustrates operating trigger G at "in" position for compressed air flow to air inlet $\mathbf{12}d_1$ for driving projectile plunger 16 ramming projectile into the tube and to the delay valve V. When the projectile plunger 16 stops (thus providing a positive indication the projectile is in position at tube entry), the air chamber in cylinder 12*a* fills and compresses the air activating or delay valve V via pilot line PL. Valve V opens sending control air to air inlet $\mathbf{12}d_3$ and hydraulic bolt to align ports 26*b* with 22*f* allowing water to pass through bolt 26 and projectile plunger 16 forcing the projectile into and through tube T.

When the projectile and deposits removed by the projectile flow from the far end of a tube, the launcher operating components are reset. Compressed air is admitted to the forward ends of both plunger and hydraulic bolt air pistons returning the components to the position of FIG. 1 for further repetitions of the operating cycle in cleaning additional tubes.

It is to be understood that the launcher embodiment of FIGS. 1-7 can be organized within a housing shell such as that described below in connection with FIGS. 8-14.

Another preferred embodiment of launcher 40 according to the invention is shown in FIGS. 8-14 comprising a launcher shell 42 having mating left and right halves joined on a common vertical plane for encasing operating components and providing a front grip 44, rear pistol grip 46 with trigger guard 46*a* and trigger-button 46*b* operated compressed air valve 48 (FIG. 9) for handling and operating the launcher, shoulder stock 50, compressed air line 52, and pressurized water connection 54. Launcher shell halves are secured to each other with suitable fasteners attached through openings 56 spaced about the housing periphery.

Figure 11:
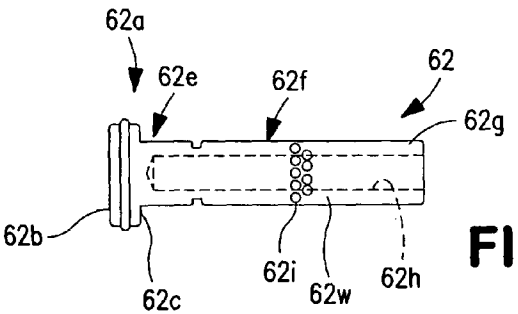
FIG. 11 is a side elevation view of hydraulic bolt, an operating component of the launcher of FIG. 8.
Figure 12:
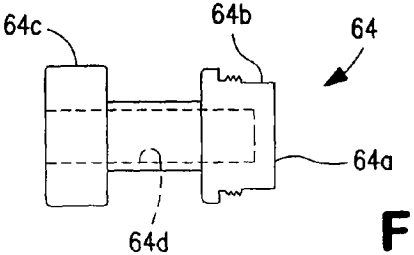
FIG. 12 is a side elevation of end cap for main housing of the launcher of FIG. 8.

The operating components comprise main housing 60 (FIG. 10) defining an inner chamber 60*a* for receiving an hydraulic bolt 62 (FIG. 11). Main housing has an inner chamber surface of varying diameters selected for cooperation with outer surfaces of the hydraulic bolt.

The rear section interior of main housing defines an annular air cylinder 60*b* for double acting air piston 62*a* formed integral with rear end of hydraulic bolt. The piston face 62*b* for forward motion of the hydraulic bolt is a circular disc with diameter of inner chamber, and piston face for rear movement of hydraulic bolt is piston annular shoulder 62*c*. An end cap 64 (FIG. 12) encloses the back of main housing 60 and has front surface 64*a* defining cylinder rear margin and rear limit of movement of the air piston 62*a*. An inwardly directed shoulder 60*c* in main housing wall defines annular cylinder 60*b* forward margin and limit of forward motion of air piston 62*a*.

The cylinder 60*b* for forward motion of the hydraulic bolt is defined as space between end cap surface 64*a* and piston face 62*d*. The cylinder 60*b* for rearward or reset motion of hydraulic bolt 62 is defined as annular space between main housing shoulder 60*c*, piston annular face 62*c* and adjacent circumferential surface 62*e* of hydraulic bolt.

Compressed air inlet openings 66 admit air to front 62*c* and rear faces 62*d* of air piston for moving hydraulic bolt through its operating cycle.

The middle section 60*e* of inner surface of main housing 60 defines a cylindrical support surface for sliding engagement with corresponding cylindrical middle surface 62*f* of hydraulic bolt.

A forward section 60*f* of the main housing is of enlarged outer diameter having bore 60*d* for receiving pressurized water pipe 54 (FIGS. 9 and 13) passing through front grip 44, and for providing a water tap 68 to indicator gauge 70 described in detail below. The inner surface 60*g* of forward section is recessed to define a water plenum 60*g* for delivery of pressurized water to hydraulic bolt in a manner described below.

The front end 60*h* of main housing has an open end 60*i* for mounting an hydraulic nozzle 72 (FIG. 9) for directing pressurized water to drive a manually placed projectile through a heat exchanger tube. Inner nozzle cylindrical surface 72*a* accommodates the cylindrical front end 60*h* of hydraulic bolt (see FIG. 14) to define a continuous passage for pressurized water from hydraulic bolt through nozzle into a heat exchanger tube.

The front end of main housing mounts a spray shield 74 (FIG. 13) in the general form of a parabolic cone having a cylindrical collar 74*a* for attachment to main housing over O-ring 60*k*. The spray shield deflects any back-splash of pressurized water during a tube cleaning operation.

Hydraulic bolt 62 is a one piece generally cylindrical body fitted with integral double acting air piston 62*a* at its rear end, a cylindrical mid body portion 62*f* for sliding engagement within main housing, a front end 62*g* with cylindrical outer surface that provides dual function of cooperating with nozzle surface 72*b* to provide through water passage into and through the nozzle, and as defining a pressurized water passage from hydraulic chamber 62*h* to indicator gauge 70 through water tap 68.

Figure 14:
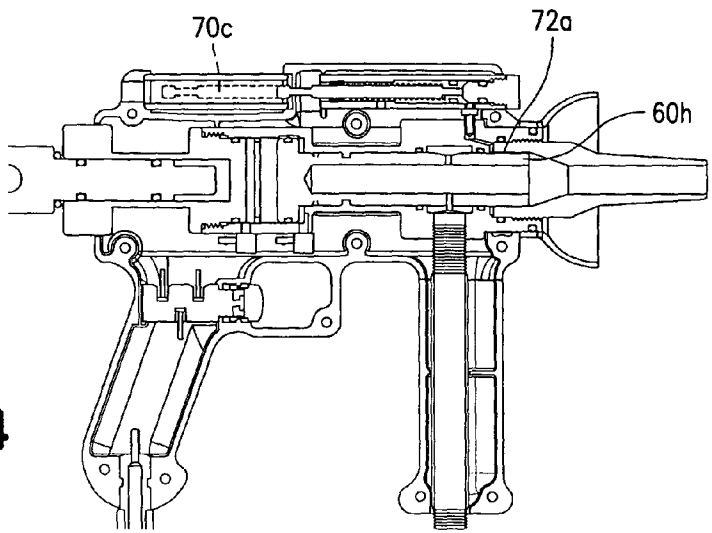
FIG. 14 is a side elevation section view of the launcher of FIG. 8 for illustrating position of water flow components in normal position.
Figure 15:
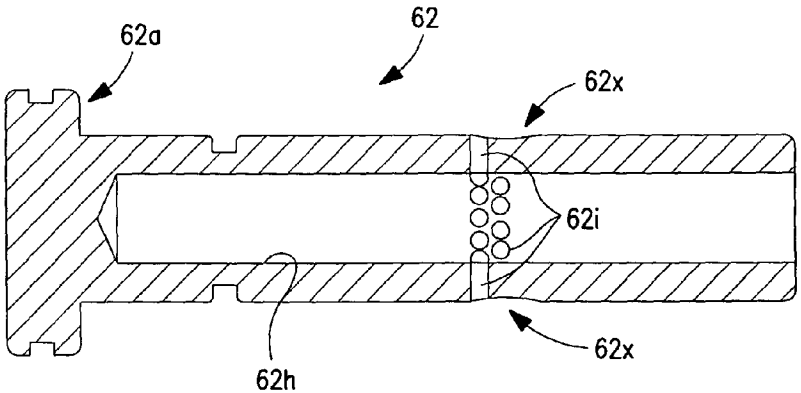
FIG. 15 is an enlarged side elevation section view of the hydraulic bolt of FIGS. 8-14 illustrating an o-ring relief surface adjacent water ports through bolt wall.
Figure 13:
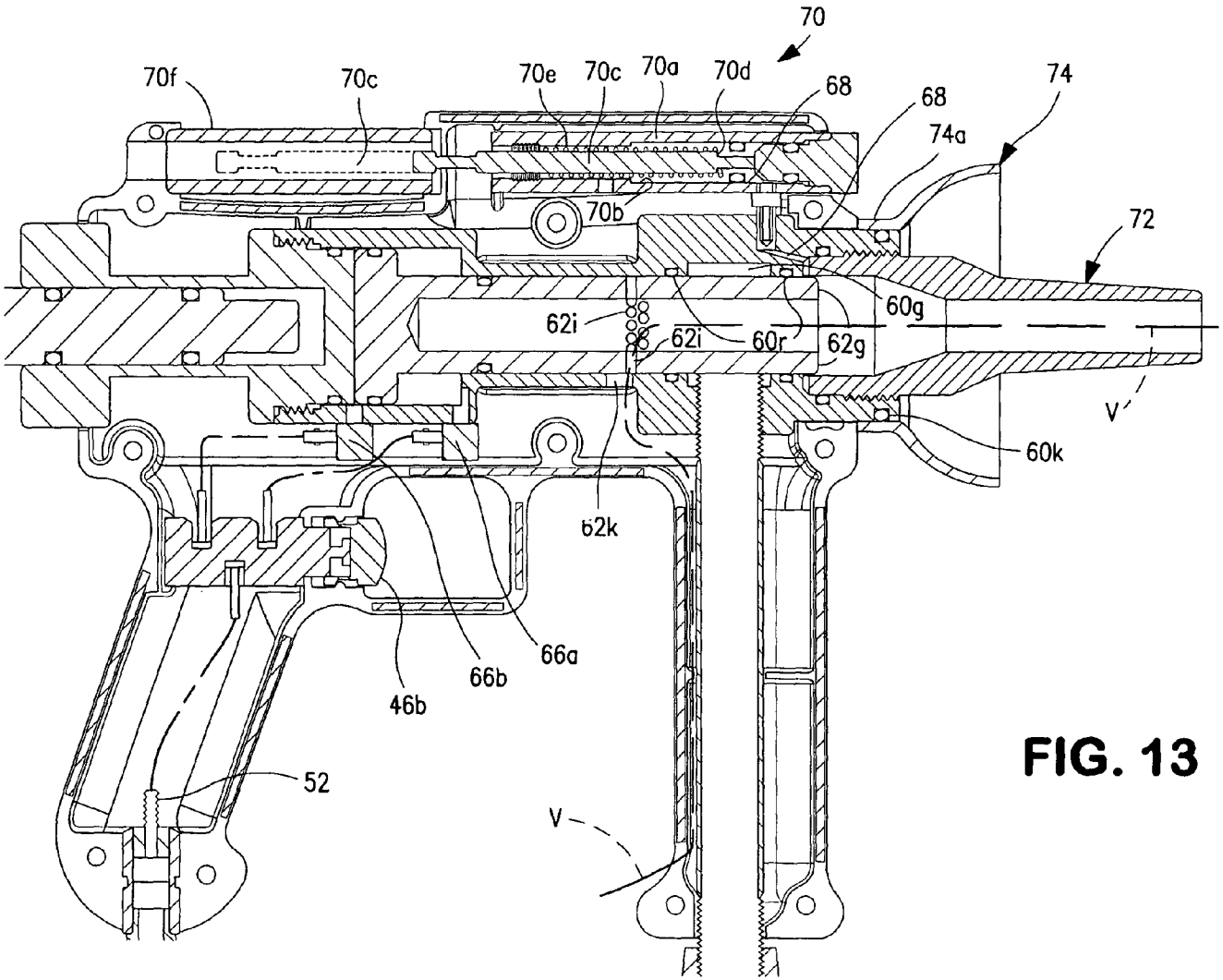
FIG. 13 is an enlarged side elevation section view of the launcher of FIG. 8 for illustrating, indicator gauge, control air path, and vacuum break path with operating components in normal position.

As best shown in FIGS. 13 and 15, hydraulic bolt wall 62*w* includes a set of circumferentially positioned water ports 62*i* with adjacent o-ring relief surface 62*x* for admitting pressurized water from water pipe 54 to hydraulic chamber 62*h* when the ports are positioned in registry with water plenum 60*g* as occurs when air piston 62*a* moves to its forward position with piston face 62*c* in abutment with housing shoulder 60*c* (FIG. 14). The relief surface 62*x* eliminates o-ring distortion of water plenum o-rings 60*r* (FIG. 13) into the circumferentially positioned water ports 62*i*. In this way, o-ring abrasion is reduced.

In operation, then, a projectile is placed manually in a heat exchanger tube opening. The tube cleaning launcher nozzle tip 72*c* is inserted into the tube behind the projectile and fires the projectile down the tube when:

compressed air is admitted to the rear end of air piston advancing the piston and hydraulic bolt until the piston abuts inner shoulder and water ports are aligned with water plenum, the front end of hydraulic bolt nests within nozzle cylinder to define a through water passage from launcher to nozzle, and pressurized water fills hydraulic bolt and drives the projectile for removing soft and hard deposits as it traverses the tube.

When the projectile passes from the far end of the tube and the trigger is released, compressed air is admitted to the front side of air piston for returning the hydraulic bolt to initial position.

An aspect of the invention is an indicator gauge 70 (FIGS. 9 and 13) providing a low pressure differential reading in a high pressure environment thus enabling a launcher operator in judging that each operating cycle of the launcher delivered a pressurized water charge of sufficient force to propel each projectile entirely through each tube cleaned. Standard gauges rated around 300 psi typically used in this environment will show little movement with low pressure differentials. The indicator according to the invention will have visible movement with as little as 1½ psi differential. Indicator gauge is mounted atop the launcher shell partially under a housing shell cover 42*a*.

Figure 9:
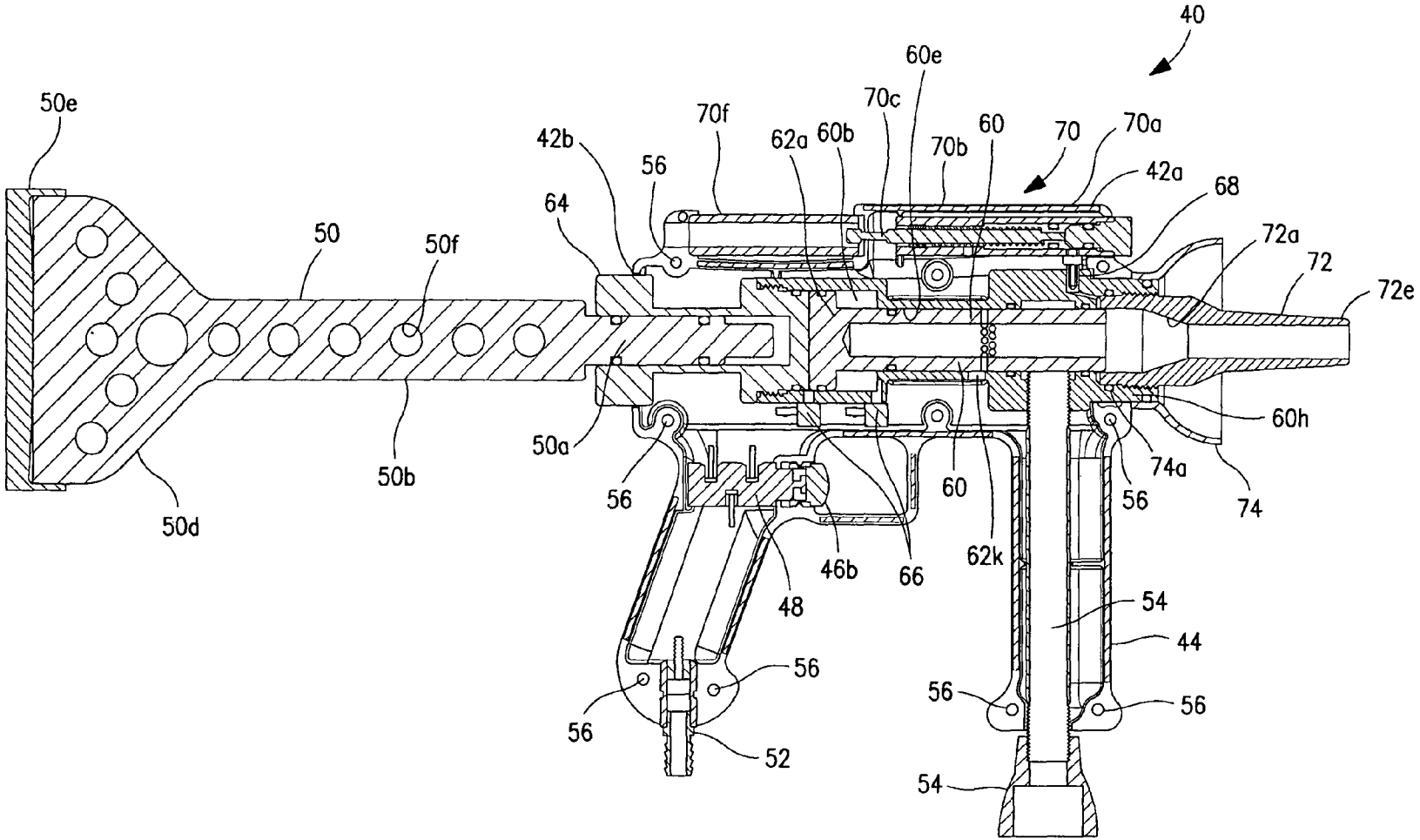
FIG. 9 is a side elevation view in section of the launcher of FIG. 8 showing launcher components in initial operating position.
Figure 10:
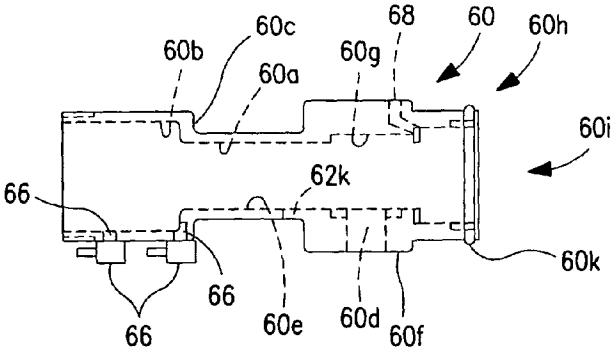
FIG. 10 is a side elevation view of main housing for operating components of the launcher of FIG. 8.

The indicator gauge comprises a water tight cylinder 70*a* with axial bore 70*b* receiving a spring biased sliding indicator rod 70*c* fitted with a water piston 70*d* mounted within the cylinder. The spring 70*e* is a compression spring, with normal position shown in FIGS. 9 and 13, having spring ends secured to indicator rod water piston and to front spring anchor. The indicator rod passes through the center of the spring and through a slit in the end of cylinder, and thence into an indicator zone defined by a clear glass tube 70*f* covering the exposed end of rod. Preferably the exposed end of indicator rod is painted red or other suitable color. Normal position for the rod is shown in FIGS. 9 and 13 where spring is fully expanded holding the rod in such position fully retracted from the sight glass 70*f*.

When the launcher is operated, as described above and the hydraulic bolt is in forward position, a full charge of pressurized water flows to the indicator gauge water piston over the front edge 62*g* of hydraulic bolt, through water tap 68 starting at rear edge of nozzle 72, through tap bore 68 and indicator cylinder wall to the water piston 70*d*. Pressurized water drives the indicator rod to the left (dash line in FIG. 13) so as to show red indicator rod occupying full length of sight glass. Such action indicates to the operator that a charge of water of sufficient force to drive a projectile through the tube was delivered by the launcher on that operating cycle. The indicator rod occupying the sight glass also signals that the projectile is still in the tube. When the projectile has exited the tube and water pressure in water tap subsides, compression spring returns the indicator rod to original position, and gives the operator a "tube clear" reading.

Referring once again to FIGS. 9 and 12, end cap 64 is secured to the end of main housing 60 by forward cylindrical embossment 64*b* having front face 64*a* defining a cylinder head described above. Rear embossment 64*c* of shape similar to forward embossment engages and passes through open end 42*b* of main housing. Bore 64*d* extends axially nearly the full length of end cap for receiving shoulder stock 50 that provides shoulder leverage for an operator using the launcher. A forward prong 50*a* having a pair of O-rings extends into the bore and secures the shoulder stock in place on the launcher. The stock further includes main body portion 50*b*, a generally triangular shoulder piece 50*d*, and protective cushion 50*e*. Lightening openings 50*f* may be formed in the stock as desired for operator comfort.

In operation of a tube cleaning launcher, an operator occasionally experiences "blow-back" of the cleaning projectile. This happens when the projectile is inserted into a blocked tube and an attempt is made to shoot it through the tube. When the launcher is removed built-up air pressure between tube blockage and projectile propels it back toward the operator sometimes at high speed, subjecting the operator to possible injury. The launcher of the invention virtually eliminates "blow-back" by means of a vacuum break/pressure relief valve that automatically vents back pressure when the operating trigger is released. That is, the tube is completely depressurized before the launcher nozzle is removed from a tube.

Referring to FIG. 13, the operating components are shown in normal position with control compressed air applied to the front face of air piston 62*a* driving the hydraulic bolt to the left. In this position, hydraulic bolt water ports 62*i* are aligned with exhaust port 62*k* (FIGS. 9 and 13). With this alignment of water ports and exhaust ports, and with the launcher components in normal position, tube interior communicates to ambiance through launcher nozzle, hydraulic chamber, water ports, exhaust port, and through the housing shell via the front grip, as shown by dash line V. When the operator releases the launcher trigger, operating components are moved by air control circuit to the normal position of FIG. 13 thereby exhausting overpressure as well as any under-pressure to atmosphere.

When operator releases trigger-button 46*b* (FIG. 13), control air flows from air inlet 52 via trigger valve 48 to air inlet port 66*a* to reset hydraulic bolt, and to release any over- or under-pressure vis exhaust port 62*k* as noted. By pressing the trigger-button, operator then directs control air through inlet port 66*b* for driving hydraulic bolt forward, and admitting pressurized water to hydraulic chamber via water ports 62*i* to launch a projectile.

FIG. 14 illustrates water flow components in normal and fire positions. In normal position, pressurized water flows through inlet line up to water plenum. When launcher is fired the hydraulic bolt advances to the position of FIG. 14 admitting pressurized water to the hydraulic chamber through water ports for driving a projectile through a tube.

Control air pressure in a range of 90 psi to 150 psi, and water pressure up to a maximum of 600 psi are recommended for operation of the launcher.

Various changes may be made to the structure embodying the principles of the invention. The foregoing embodiments are set forth in an illustrative and not in a limiting sense. The scope of the invention is defined by the claims appended hereto.

We claim:

1. A launcher for tube cleaning projectiles comprising a housing in the form of an elongate cylinder having an internal axial chamber, a portion of the axial chamber defining an air cylinder, a water inlet through the housing, a water plenum formed within the chamber for receiving pressurized water from an external source through the water inlet, a first set of water ports communicating plenum to water inlet, an hydraulic bolt received axially within the internal chamber, the hydraulic bolt being supported for sliding axial movement within the chamber, the bolt having an internal hydraulic chamber and a second set of water ports for admitting pressurized water from the plenum into the hydraulic chamber, the hydraulic bolt having an air piston cooperating with said air cylinder for moving hydraulic bolt from normal position to launch position so that the first set of water ports register with the second set of water ports thereby admitting pressurized water into the hydraulic chamber, and for resetting the hydraulic bolt to normal position, a valve connected to a source of compressed air, the valve having a first position for admitting compressed air to the air piston to move the hydraulic bolt to register first and second sets of ports, the valve having a second position for admitting compressed air to the air piston to reset the hydraulic bolt to normal, and the launcher having means for directing pressurized water from the hydraulic chamber to propel a cleaning projectile through a heat exchanger tube.

2. A launcher for tube cleaning projectiles comprising a housing in the form of an elongate cylinder having an exterior wall and an internal axial chamber, a portion of the axial chamber defining a first air cylinder, a water inlet through the housing exterior wall, a spool valve in fixed position in the internal chamber defining a water plenum within the chamber for receiving pressurized water from an external source through the water inlet, the spool valve having a first set of water ports communicating plenum to water inlet, an hydraulic bolt received axially within the internal chamber and supported for sliding axial movement therein by the spool valve axial bore, the bolt having an internal hydraulic chamber and a second set of water ports for admitting pressurized water from the plenum into the hydraulic chamber, the hydraulic bolt having a double acting air piston cooperating with said air cylinder for moving hydraulic bolt from normal position to launch position so that the first set of water ports register with the second set of water ports thereby admitting pressurized water into the hydraulic chamber, and for resetting the hydraulic bolt to normal position, the housing having an open front end and having a muzzle affixed to the front end, the muzzle having an open magazine into which projectiles are loaded, the muzzle having in inner axial cylindrical surface, a projectile plunger in the form of an elongate cylinder with inner axial cylindrical bore, the projectile plunger positioned within the housing with its axial bore supported by external surface of hydraulic bolt and with its exterior surface supported by muzzle inner axial surface, another portion of the housing axial chamber defining a second air cylinder, the projectile plunger having a double acting air cylinder cooperating with the second air cylinder for moving the projectile plunger axially through the magazine for driving a projectile into firing position in a tube, and to reset the projectile plunger to normal position, first and second valves connected to a source of compressed air, the first valve having a first position for admitting compressed air to the second air piston to move the projectile plunger to drive a projectile into launch position in a heat exchanger tube, the valve having a second position for admitting compressed air to the air piston to reset the projectile plunger to normal position, the second valve having a first position for admitting compressed air to the first air piston to move the hydraulic bolt to register first and second sets of ports for directing pressurized water through the hydraulic chamber to propel a cleaning projectile through a heat exchanger tube, the second valve having a second position for admitting compressed air to the air piston to reset the hydraulic bolt to normal position.

3. A launcher for driving cleaning projectiles through heat exchanger tubes comprising an open-ended housing, the housing having an external wall defining interior spaces for receiving operating components, a first interior space defining an air cylinder, a second interior space defining a cylindrical support surface for sliding engagement with an hydraulic bolt, and a third interior space defining a water plenum, a water line passing through the housing external wall to supply water to the plenum, an end cap in one end of the housing cooperating with the first interior space to define the air cylinder, the air cylinder further defined by a shoulder formed in the housing wall, an hydraulic bolt received within the internal spaces, the hydraulic bolt having a double acting air piston situated in the air cylinder, the hydraulic bolt having a body portion for sliding support in the second interior space, the hydraulic bolt having an interior hydraulic chamber for receiving pressurized water for launching projectiles through tubes, a nozzle positioned in the other end of the housing communicating with the hydraulic chamber for directing pressurized water at a projectile positioned in a tube, at least one water port in the hydraulic bolt for entry of water into the hydraulic chamber, the hydraulic bolt having a normal position where the hydraulic chamber is void of water and a firing position where pressurized water is admitted to the hydraulic chamber and nozzle for firing a projectile through a tube, a compressed air control system for admitting compressed air to one side of the double acting piston so as to slide the hydraulic bolt into position where the at least one water port registers with the water plenum for admitting pressurized water to pass into the hydraulic chamber and through the nozzle for driving the projectile through a tube, and the compress air control system for further admitting compressed air to the other side of the piston for resetting the hydraulic bolt to normal position.

4. A launcher as defined in claim 3 further comprising a housing shell encasing the launcher, the shell having hand grips enabling an operator to insert the nozzle in a tube end for filing a projectile.

5. A launcher as defined in claim 3 further comprising a housing shell encasing the launcher, the shell having a front grip and a pistol grip enabling an operator to insert the nozzle in a tube end for filing a projectile, the water line passing through the front grip and through the housing external wall, the pistol grip mounting the air control system, an air inlet passing into the pistol grip, an air valve within the pistol grip having a first position for admitting compressed air to one side of the air piston, and a second position for admitting compressed air to the other side of the air piston.

6. A launcher as defined in claim 3 further comprising a spray shield about the nozzle.

7. A launcher as defined in claim 4 which further comprises a shoulder stock secured to the end cap.

8. A launcher as defined in claim 4 which further comprises a removable shoulder stock secured to the end cap.

9. A launcher as defined in claim 3 which further comprises an exhaust port through the housing wall, the exhaust port being positioned in the wall to be in registry with the hydraulic bolt water port when the bolt is in normal position, so that the interior of a tube is vented to ambiance to relieve overpressure or vacuum in the tube after firing a projectile and resetting the bolt.

10. A launcher as defined in claim 3 further comprising an indicator gauge with greater movement using low pressure differential in a high pressure environment.

11. A launcher as defined in claim 3 further comprising an indicator gauge having a water cylinder, a spring biased indicator rod having a water piston at one end, the rod and piston mounted within the water cylinder, the water cylinder having an opening for movement of the other end of the rod therethrough, a transparent sight glass cooperating with the water cylinder to receive the rod as it passes through the opening, a water tap through the housing wall for receiving pressurized water during projectile launch and for directing the water to the water cylinder so that when a projectile is fired with pressurized water the water piston moves the other end of the rod into the sight glass providing the launcher operator with an indications that a projectile is passing through a tube, and that the tube is cleared.

* * * * *